United States Patent [19]

Keeney

[11] 4,223,630

[45] Sep. 23, 1980

[54] JET BOAT REVERSING UNIT

[76] Inventor: Lloyd E. Keeney, 4950 Hatt Rd., Jackson, Mich. 49201

[21] Appl. No.: 940,282

[22] Filed: Sep. 7, 1978

[51] Int. Cl.[3] ..... B63H 11/00

[52] U.S. Cl. ..... 440/41; 60/222; 114/151; 440/42

[58] Field of Search ..... 60/221, 222; 115/11, 115/12 R, 12 A, 14, 15, 16, 35, 39, 42; 114/151

[56] References Cited

U.S. PATENT DOCUMENTS

| | | | |
|---|---|---|---|
| 3,146,586 | 9/1964 | Newby | 115/12 R |
| 3,185,124 | 5/1965 | Spence | 115/12 R |
| 3,610,556 | 10/1971 | Charlton | 115/12 R |
| 3,776,173 | 12/1973 | Horowitz | 115/12 R |
| 3,842,787 | 10/1974 | Giacosa | 115/16 |
| 3,854,437 | 12/1974 | Stansbury | 115/12 R |
| 4,047,494 | 9/1977 | Scott | 115/12 R |

*Primary Examiner*—Trygve M. Blix
*Assistant Examiner*—D. W. Keen
*Attorney, Agent, or Firm*—Beaman & Beaman

[57] ABSTRACT

The invention pertains to reversing apparatus for hydraulic jet marine drives utilizing a pivoted steering nozzle and a reversing gate adapted to divert a jet of water into a reversing nozzle. The reversing nozzle is rotatably mounted upon the steering nozzle and utilizes orientation apparatus fixed with respect to the axis of the steering nozzle such that rotation of the steering nozzle in one direction produces rotation of the reversing nozzle about its axis in the opposite direction. The relative movements of the steering and reversing nozzles produces force vectors in the nozzles in a common lateral direction with respect to boat movement wherein a high degree of boat control while being reversed is achieved at low pumping capacity.

7 Claims, 6 Drawing Figures

JET BOAT REVERSING UNIT

SUMMARY OF THE INVENTION

The invention pertains to a marine jet drive and particularly relates to reversing apparatus therefore.

Jet propulsion drives for sport marine use are becoming increasingly popular. Basically, such drives consist of a pump mounted in the stern of the craft having an inlet extending through the craft bottom, and an outlet in the stern. Pump impeller means driven by an engine rapidly forces water through the outlet providing propulsion. Steering is accomplished by means of a steering nozzle located in the outlet adapted to pivot about a substantially vertical axis whereby deviation of the steering nozzle axis from the boat axis produces a side thrust. Also, some drive units include means for pivoting the steering nozzle in a vertical plane to adjust the elevation of the stern during operation.

The reversing of marine jet drives is normally accomplished by directing the water passing through the steering nozzle into a reversing nozzle integrally defined on the lower portion of the steering nozzle. The water is diverted into the reversing nozzle by means of a reversing gate mounted on the steering nozzle to block the outlet thereof and divert water into the reversing nozzle. As the reversing nozzle extends obliquely "forward" a reverse thrust is produced which permits a reverse directional movement of the craft while under power.

In the usual marine jet drive construction the reverse nozzle is rigid with respect to the steering nozzle and steering of the craft while reversing is accomplished by pivoting the steering nozzle. However, because the fluid movement within the steering nozzle and reversing nozzles produce lateral force vectors in opposite directions, and because the angular deviation of the reversing nozzle with respect to the boat axis is not great, the maneuverability of a jet drive craft while in reverse is very limited and steering is most difficult. This steering problem while in reverse renders docking of the craft, and other close maneuvering, very difficult, even for the expert operator, and one of the primary objections to marine jet drives is the difficulty of boat maneuverability in reverse.

Typical marine jet drives using reversing devices are shown in U.S. Pat. Nos. 1,629,767; 3,052,093; 3,030,909; 3,146,586; 3,185,124; 3,387,583; 3,478,712; 3,543,713; 3,624,737 and 3,854,437. These prior art devices do not provide a practical solution to the problems of maneuvering available jet drives in reverse.

It is an object of the invention to provide a reversing apparatus for marine jet drives wherein maneuverability of the craft while in reverse is substantially improved over conventional reversing means, and in the practice of the invention the reversing of a jet craft actually becomes superior to the reversing maneuverability achievable with conventional propeller drives.

A further object of the invention is to provide reversing apparatus for a marine jet drive which is of a relatively simple construction and may be utilized with jet drive apparatus presently on the market with a minimum of modification and expense.

An additional object of the invention is to provide reversing apparatus for a marine jet drive wherein lateral thrusting forces within the drive steering nozzle and reversing nozzle are in a common direction during steering while the components are in the reversing direction.

In the practice of the invention the reversing nozzle is rotatably mounted upon the steering nozzle for separate rotation about an axis substantially parallel to the axis of the steering nozzle wherein the direction of water flow through the reversing nozzle may be independently regulated with respect to the direction of orientation of the steering nozzle.

The reversing nozzle is automatically positioned by means of a linkage attached to the reversing nozzle and fixed at one end to an anchor point stationary relative to the steering nozzle. Thus, as the steering nozzle is pivoted for steering purposes during reversing, the reversing nozzle is automatically rotated relative to the steering nozzle due to the associated linkage, and the deviation of the flow angle through the reversing nozzle relative to the axis of the steering nozzle is automatically proportionally maintained during steering while in reverse.

As the movement of water through both the steering nozzle and reversing nozzle produces thrusting forces having vectors lateral to the axis of the craft when the steering nozzle and reversing nozzle are angularly disposed to the craft axis such thrust forces affect the boat movement during reversing. In the practice of the invention the reversing nozzle is rotated in an opposite direction to that of the steering nozzle during reversing, and this relative movement of the nozzles produces lateral force vectors in a common direction to augment craft maneuverability while in reverse. In a conventional jet drive reverse apparatus the lateral forces within the steering and reversing nozzles tend to counteract each other reducing the efficiency of the drive during reversing.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
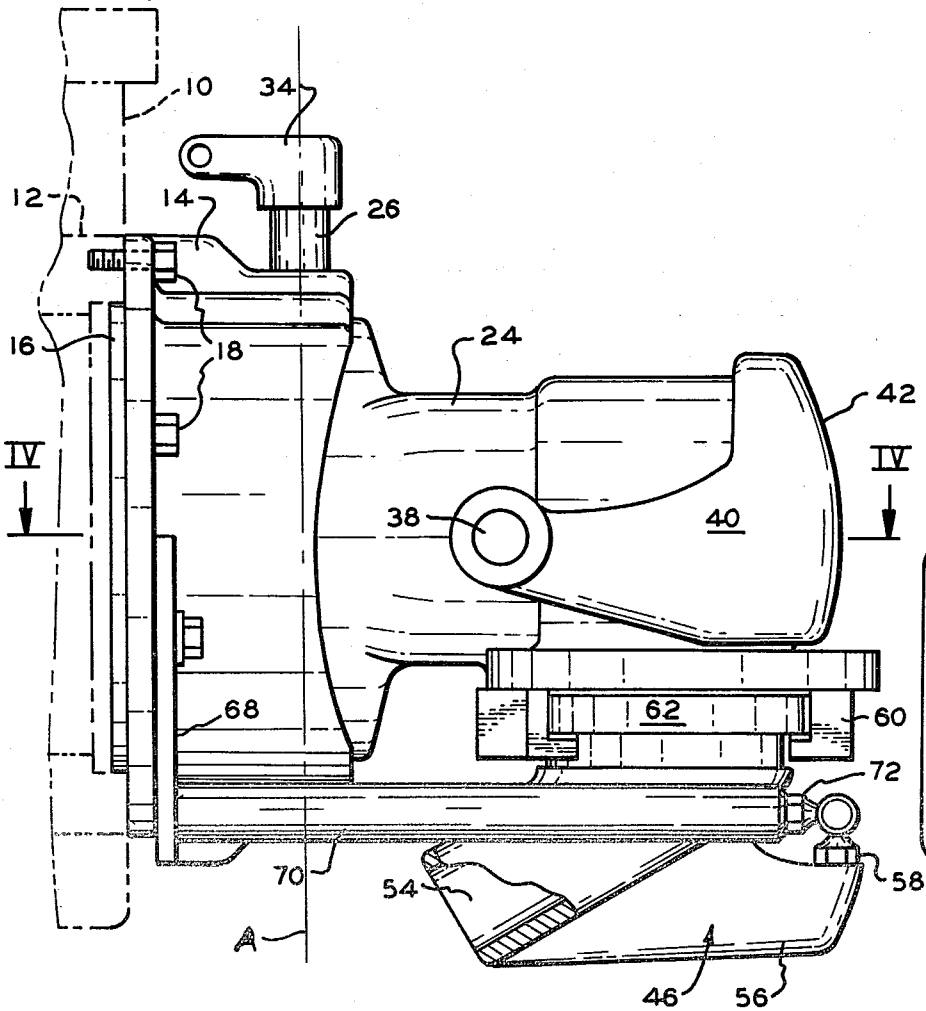
FIG. 1 is a side, elevational view, partially in section, illustrating the jet drive reversing apparatus in accord with the invention, the reversing gate being in the operative position.
Figure 4:
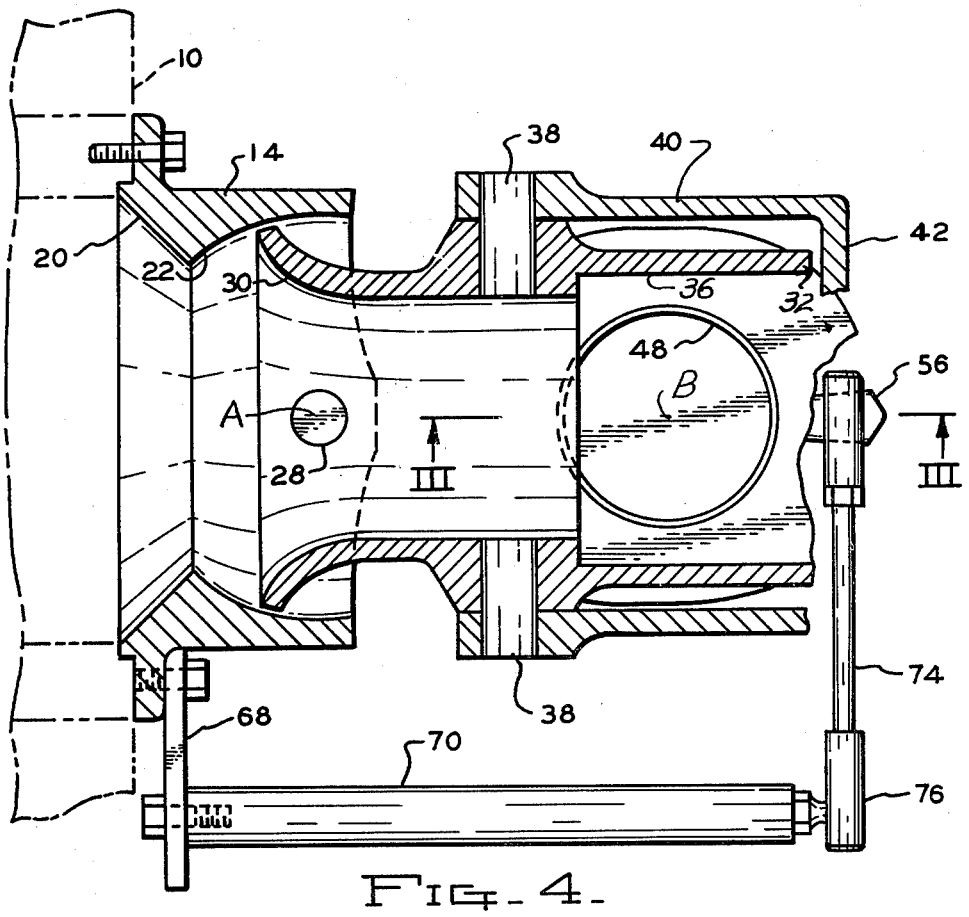
FIG. 4 is a plan, enlarged, detail, sectional view, partially broken away, through the reverse drive apparatus as taken along Section IV—IV of FIG. 1.

With reference to FIG. 1, the basic components utilized in a standard marine jet drive are illustrated. The apparatus illustrated, other than the reversing structure, is conventional, and similar to that manufactured by Berkeley Pump Company of Berkeley, California, Model 12JA. The drive unit is mounted upon the boat transom 10, and within the boat the motor driven pump, generally indicated at 12, is mounted adjacent the transom. An adapter 14 is bolted to the pump outlet 16 by bolts 18, and the adapter is of a tubular configuration including a conical stream reducing surface 20, FIG. 4, and spherical surface 22 closely cooperating with the bell of the steering nozzle as will be later explained. Pivot shaft openings are diametrically defined in the adapter defining a substantially vertical axis A, and the steering nozzle pivot shaft is actually in two coaxial portions located at the upper and lower regions of the adapter for reception into the adapter openings so as not to obscure the flow passage therethrough.

The tubular steering nozzle 24 is pivotally mounted to the adapter by pivot shaft portions 26 and 28 received in the adapter openings for pivoting relative to the adapter about the axis A. The steering nozzle includes a bell-shaped inlet 30, and an outlet or discharge end 32. The steering arm 34, FIG. 1, attached to the upper pivot shaft 26 permits the steering nozzle 24 to pivot about its axis A and thereby vary the horizontal direction that the jet of water is directed to provide watercraft steering. As will be apparent from FIGS. 5 and 6, the bell configuration of the steering nozzle inlet permits a substantially sealed relationship to exist between the steering nozzle and adapter at all positions of the steering nozzle and the discharge end of the steering nozzle is provided with an enlarged cylindrical surface 36 to facilitate water flow into the reversing nozzle.

The steering nozzle is provided with a pair of coaxial shafts 38 disposed in diametrical relationships upon the nozzle to define a horizontal axis. The reversing gate 40 is pivotally mounted upon the shafts 38 and includes a barrier portion 42 adapted to be disposed in alignment with the steering nozzle outlet 32 so as to block the outlet against fluid flow therethrough. The reversing gate 40 is operated by a lever 44, FIG. 2, through appropriate operating means, not shown whereby the reversing gate may be pivoted between the operative position of FIG. 1, and an inoperative position wherein the barrier 42 is disposed above the steering nozzle and the water may freely flow directly through the steering nozzle from the discharge end 32.

The reversing nozzle is generally indicated at 46, and is rotatably mounted on the underside of the steering nozzle adjacent the discharge end 32. An opening 48 of circular configuration is defined in the steering nozzle having an axis B which is substantially vertical and substantially parallel to the axis A, and is centrally located with respect to the steering nozzle 24. The opening 48 is circumscribed by a flat, circular seal surface 50 against which a sealing flange defined upon the reversing nozzle engages. The reversing nozzle 46 includes an upper passage 52 of circular configuration and of a diameter substantially corresponding to the opening 48. The lower portion 54 of the reversing nozzle passage is angularly oriented to the vertical as will be appreciated from FIGS. 1 and 3, and extends "forwardly" with respect to the direction of boat forward movement. The nozzle includes a rearwardly extending vane 56, and a knuckle joint ball 58 is threadily mounted upon the vane in axially spaced relationship to the reversing nozzle axis of rotation B.

Figure 3:
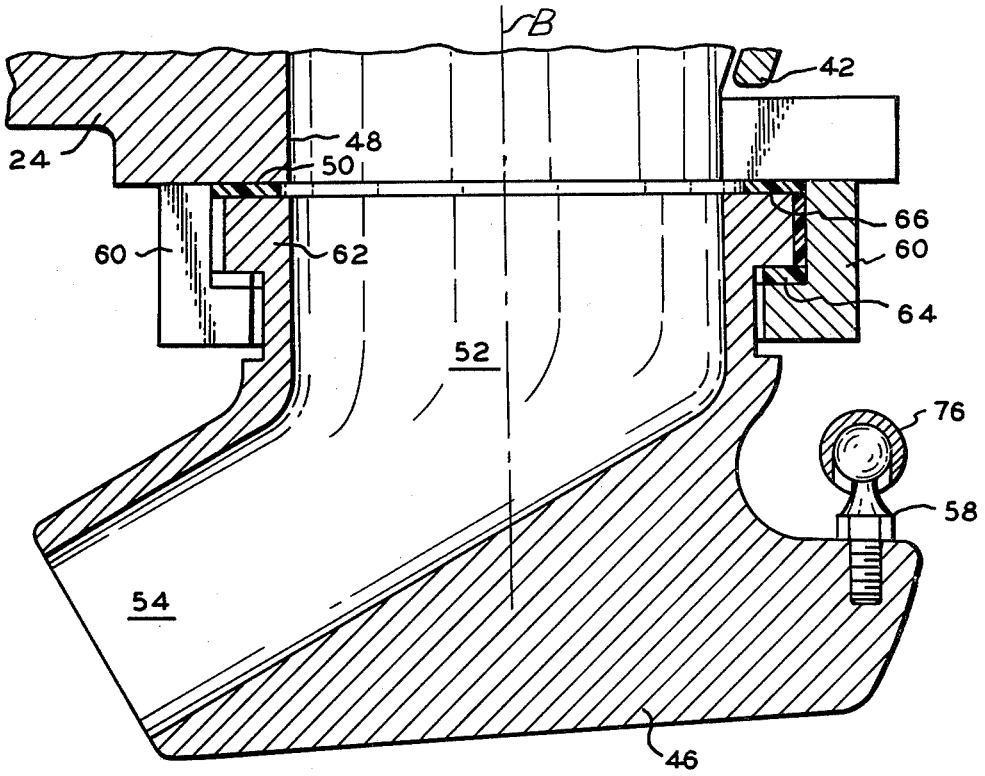
FIG. 3 is an enlarged, detail elevational sectional view of the reversing nozzle as taken along Section III—III of FIG. 4.

A plurality of retainer fingers 60 are mounted upon the steering nozzle about opening 48 by screws, not shown, and the fingers include a portion which underlies the circular reversing nozzle flange 62, FIG. 3. Bearing material strips 64 are located between the fingers and the circular flange, and an annular bearing material ring 66, such as of nylon, is also located between the steering nozzle flange and the flat circular reversing nozzle surface 50. Thus, it will be appreciated that an effective bearing and seal is established between the reversing nozzle 46 and the steering nozzle 24, and the reversing nozzle is capable of freely rotating about the axis B relative to the steering nozzle.

Figure 2:
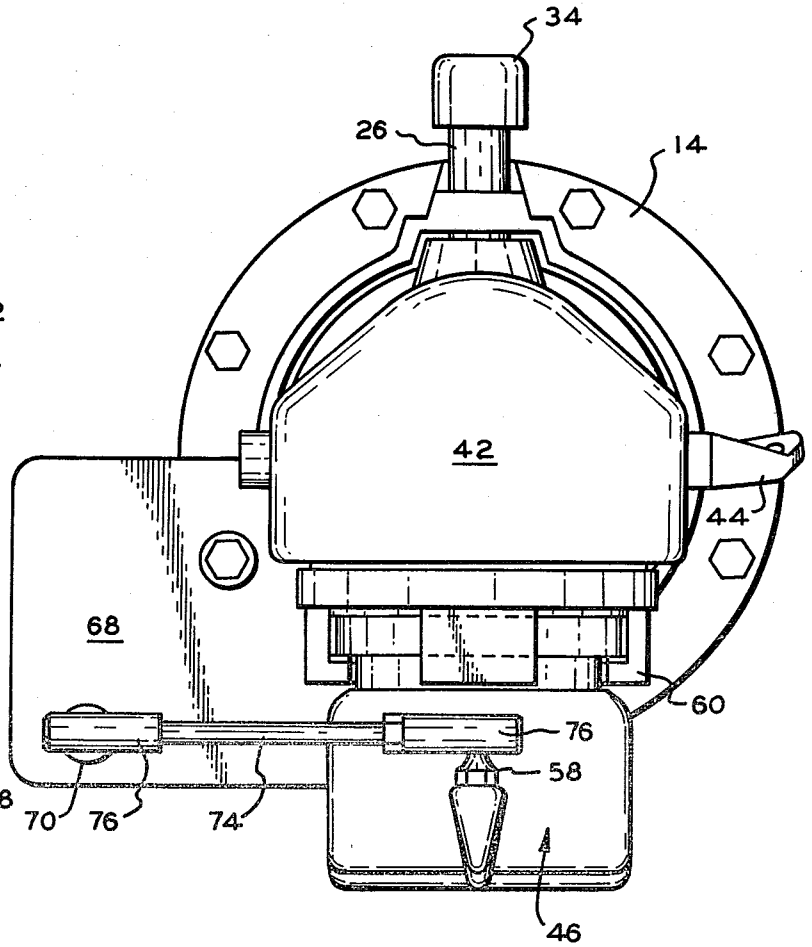
FIG. 2 is an elevational rear view of the apparatus as taken from the right of FIG. 1.

An anchor plate 68 is bolted to the adapter 14, and serves to support an anchor post or column 70 which rigidly extends rearwardly from the adapter, and is offset to one side of the reversing nozzle as will be appreciated from FIG. 2. A knuckle joint ball 72 is mounted at the free end of the post 70, and a rigid link 74 is interposed between the balls 58 and 72 and connected thereto by conventional ball sockets 76. Thus, the link 74 connects the reversing nozzle 46 to the post 70 in a manner which permits pivoting of the reversing nozzle as the steering nozzle pivots about its axis A.

The operation of the disclosed apparatus will now be described:

When the water craft is to be propelled in a forward direction the operator raises the reversing gate 40 to permit the water pumped into the steering nozzle 24 to be directly discharged through the outlet end 32. Steering is produced by rotating the steering nozzle about its axis A by means of the steering arm 34, and forward control is achieved in the normal manner.

When it is desired to reverse the direction of watercraft movement, such as for docking and close maneuvering, the engine is idled which minimizes the water velocity through the steering nozzle 24, and the reversing gate 40 is lowered to the position of FIGS. 1 and 2. The water discharge is now directed to the opening 48 into the reversing nozzle passage 52 and the water is discharged through the reversing nozzle outlet passage 54. If the steering nozzle axis is parallel to the longitudinal axis of the boat the water emitting from the reversing nozzle will impose a force vector on the steering nozzle in the reverse direction tending to stop forward motion and cause the boat movement to reverse. This reverse force vector is greater than the forward vector resulting from fluid flow within the steering nozzle 24 tending to move the boat forward.

Figure 5:
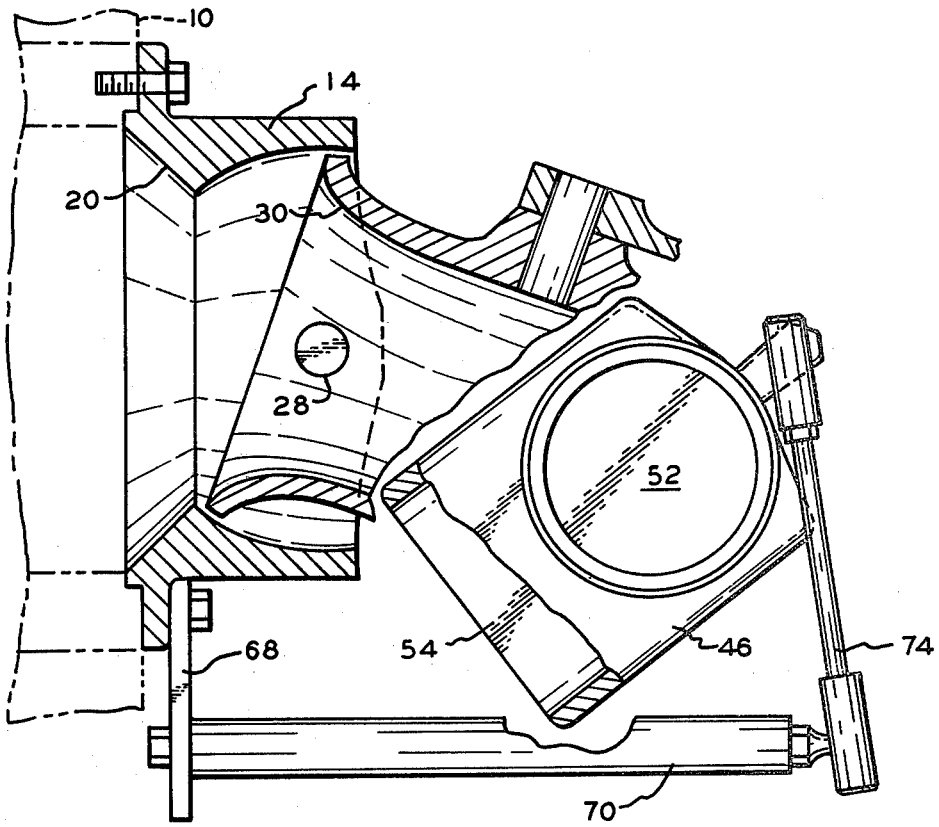
FIG. 5 is an enlarged, detail, sectional view similar to FIG. 4, the steering nozzle being broken away to show the remaining nozzle and illustrating the apparatus in the relationship for producing a right thrust.
Figure 6:
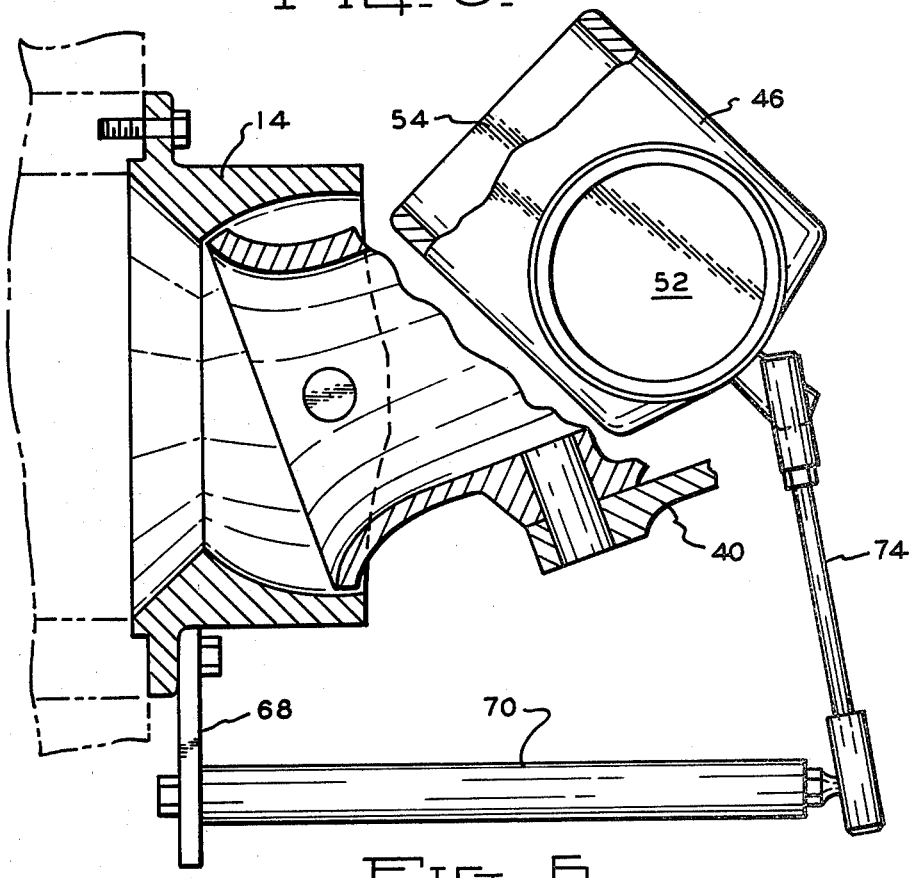
FIG. 6 is a plan, detail, sectional view similar to FIG. 5 illustrating the components in the relationship for producing a left rear craft thrust.

Of course, when reversing it is usual to desire lateral movement in one direction or the other, and such movement is produced by pivoting the steering nozzle 24. As the steering nozzle is rotated from the boat aligned "straight" position shown in FIG. 4, to the unaligned positions of FIGS. 5 or 6, pivoting of the steering nozzle will laterally displace reversing nozzle 46 and its axis B relative to the pivot axis A. Such movement causes a pivoting of the reversing nozzle about its axis B due to the presence of the link 74. If the steering nozzle 24 is rotated in a clockwise direction, FIG. 4, this movement will cause a counterclockwise pivoting of the reversing nozzle 46, and as shown in FIG. 6, a counterclockwise rotation of the steering nozzle about its axis A will produce a clockwise direction of rotation of the reversing nozzle. Such movement of the steering nozzle causes the flow axis or discharge of the reversing nozzle to be obliquely disposed to the adapter flow axis and produce a lateral force vector which effectively laterally displaces the jet drive mechanism and boat stern. In FIG. 5, such displacement will occur in the direction to the right with respect to the boat forward motion, and to the left in FIG. 6. In FIGS. 5 and 6 substantially extreme positions of the reversing nozzle 46 are illustrated, and it will be appreciated that the degree of rotation of the reversing nozzle is directly proportional to the degree of pivoting of the steering nozzle 24 about its axis A.

The improved steering resulting from the practice of the invention arises from two factors. First, the relative rotation of the reversing nozzle upon the steering nozzle permits the flow axis of the reversing nozzle to be disposed at a greater angle to the adapter flow axis than is possible when the reversing nozzle is fixed upon the steering nozzle as is the conventional construction. Thus, a greater lateral force vector is produced than with the conventional construction. Secondly, whenever the steering nozzle 24 is pivoted out of alignment of the adapter axis a lateral force vector is produced upon the steering nozzle by the fluid flow therein, and due to the "counter" rotation of the reversing nozzle the lateral force vector imposed on the reversing nozzle due to the water being ejected from the reversing nozzle along its flow axis is in the same lateral direction as the lateral force vector being produced within the steering nozzle, and the combination of these force vectors imposes a greater lateral force on the apparatus than is achievable in the standard construction wherein the lateral force vectors within the steering nozzle and reversing nozzle act in opposite directions and with the invention it is possible to achieve excellent reverse movement and maneuverability with the pump engine idling, and this is an important safety aspect.

Conventional jet drive apparatus may be modified to utilize the invention by machining the steering nozzle to permit rotatable mounting of the reversing nozzle 46, and the anchor post 70, plate 68, and linkage 74 may be readily mounted upon conventional jet drive apparatus.

It is appreciated that various modifications to the inventive concepts may be apparent to those skilled in the art without departing from the spirit and scope of the invention. For instance, the bearing structure for the reversing nozzle may use roller bearings or the like to maintain the assembly of the steering and reversing nozzles.

I claim:

1. Reversing apparatus for a hydraulic jet marine drive having a steering nozzle pivotal about a substantially vertical axis adapted to discharge water along a flow axis through an outlet, a reversing nozzle inlet opening communicating with said steering nozzle and a reversing gate movably mounted upon the steering nozzle adapted to be selectively positioned within said outlet to direct water into said reversing nozzle inlet opening, a reversing nozzle mounted on the steering nozzle having an inlet communicating with the reversing nozzle inlet opening and an outlet having an axis of discharge, bearing means rotatably mounting said reversing nozzle on the steering nozzle about a pivot axis radially spaced from the steering nozzle axis whereby said discharge axis may be obliquely related to the flow axis of the steering nozzle, the improvement comprising reversing nozzle orienting means connected to said reversing nozzle and fixed with respect to the steering nozzle axis whereby pivoting of the steering nozzle about its axis pivots said reversing nozzle about its axis in the opposite direction to obliquely orient said discharge axis relative to the steering nozzle flow axis at a variable angle directly related to the extent of pivoting of the steering nozzle about its pivot axis whereby the turning reaction forces within the steering nozzle and reversing nozzle are complementary.

2. In a reversing apparatus for a hydraulic jet marine drive as in claim 1, said reversing nozzle orienting means including a linkage having a first end pivotally connected to said reversing nozzle at a location radially spaced from the pivot axis thereof and a second end pivotally affixed to anchor means fixed with respect to the pivot axis of the steering nozzle, the reversing nozzle bearing axis being intermediate the steering nozzle axis and said linkage first end.

3. In a reversing apparatus for a hydraulic jet marine drive as in claim 2 wherein said anchor means comprises a rigid post mounted to support means supporting the steering nozzle.

4. Reversing apparatus for a hydraulic jet marine drive comprising, in combination, a tubular steering nozzle adapter having a first flow axis, a steering nozzle pivotally mounted on said adapter upon a substantially vertical pivot axis having a second flow axis, an inlet end communicating with said adapter and an outlet end, means for pivoting said steering nozzle, a reversing gate movably mounted on said steering nozzle adapted to selectively close said nozzle outlet end, a reversing nozzle inlet opening defined in said nozzle intermediate said ends thereof, a reversing nozzle rotatably mounted on said steering nozzle about an axis and communicating with said opening and having a third flow axis, and reversing nozzle orienting means interconnecting said reversing nozzle and a point fixed relative to said adapter pivoting said reversing nozzle about its pivot axis, upon pivoting of said steering nozzle about its pivot axis, in a direction such that the force vectors transverse to said first flow axis of said second and third flow axes due to fluid flow through said steering and reversing nozzles are in a common direction.

5. In a reversing apparatus for a hydraulic jet marine drive as in claim 4 wherein said nozzle orienting means comprises a link pivotally connected at one end to said reversing nozzle at a location radially spaced from the reversing nozzle axis of rotation and pivotally connected at the other end to an anchor pivot fixed with respect to said adapter.

6. In a reversing apparatus for a hydraulic jet marine drive as in claim 5 wherein said anchor pivot is defined upon a rigid post mounted upon said adapter.

7. In a reversing apparatus for a hydraulic jet marine drive as in the claim 5 wherein said reversing nozzle axis is located intermediate said steering nozzle axis and said location said link is pivotally connected to said reversing nozzle.

* * * * *